US009493864B2

(12) United States Patent
Ehrhardt et al.

(10) Patent No.: US 9,493,864 B2
(45) Date of Patent: Nov. 15, 2016

(54) LINE PIPE STEELS AND PROCESS OF MANUFACTURING

(71) Applicant: AM/NS CALVERT LLC, Calvert, AL (US)

(72) Inventors: Bertram Wilhelm Ehrhardt, Mobile, AL (US); Chris John Paul Samuel, Mobile, AL (US); Ranbir Singh Jamwal, Mobile, AL (US); Gerald McGloin, Saraland, AL (US); Stanley Wayne Bevans, S.W. Decatur, AL (US); Markus Wilhelm Forsch, S. Mobile, AL (US); Rudolf Schonenberg, Calvert, AL (US)

(73) Assignee: AM/NS Calvert LLC, Calvert, AL (US)

( * ) Notice: Subject to any disclaimer, the term of this patent is extended or adjusted under 35 U.S.C. 154(b) by 251 days.

(21) Appl. No.: 14/210,624

(22) Filed: Mar. 14, 2014

(65) Prior Publication Data

US 2014/0261915 A1 Sep. 18, 2014

Related U.S. Application Data

(60) Provisional application No. 61/792,794, filed on Mar. 15, 2013.

(51) Int. Cl.

| | |
|---|---|
| ***C22C 38/58*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |

(Continued)

(52) U.S. Cl.

CPC ..... *C22C 38/58* (2013.01); *C21D 8/021* (2013.01); *C21D 8/0426* (2013.01); *C22C 38/001* (2013.01); *C22C 38/005* (2013.01); *C22C 38/02* (2013.01); *C22C 38/04* (2013.01); *C22C 38/08* (2013.01); *C22C 38/12* (2013.01); *C22C 38/14* (2013.01); *C22C 38/16* (2013.01); *C22C 38/20* (2013.01); *C22C 38/22* (2013.01); *C22C 38/26* (2013.01); *C22C 38/28* (2013.01);

(Continued)

(58) Field of Classification Search

CPC ..... C22C 38/58; C22C 38/001; C22C 38/02; C22C 38/04; C22C 38/08; C22C 38/12; C22C 38/14; C22C 38/16; C22C 38/20; C22C 38/22; C22C 38/26

See application file for complete search history.

(56) References Cited

U.S. PATENT DOCUMENTS 8,337,643 B2 * 12/2012 Sun ..... C22C 38/002 148/332
9,057,123 B2 * 6/2015 Takashima ..... B21B 1/26 148/337

(Continued)

FOREIGN PATENT DOCUMENTS

JP 2013011005 A * 1/2013

*Primary Examiner* — Veronica F Faison
(74) *Attorney, Agent, or Firm* — Dinsmore & Shohl LLP

(57) ABSTRACT

A process for producing high strength steel is provided. The process includes providing a steel slab having a chemical composition in weight percent within a range of 0.025-0.07 C, 1.20-1.70 Mn, 0.050-0.085 Nb, 0.022 max Ti, 0.065 max N, 0.0040 max S, 0.10-0.45 Si, 0.070 max P, with the balance being Fe and incidental impurities. The steel slab is soaked within a temperature range of 1150-1230° C., hot rolled using a roughing treatment in order to produce a transfer bar and further hot rolled using a finishing treatment in order to produce hot rolled strip. The hot rolled strip is cooled using a cooling rate between 10-100° C./second (sec) and coiled within a temperature range of 580-400° C. Finally, the coiled hot rolled strip has a yield strength of at least 80 ksi and a DWTT transition temperature equal or less than −20° C.

17 Claims, 5 Drawing Sheets

(51) Int. Cl.

| | |
|---|---|
| ***C22C 38/16*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C21D 8/02*** | (2006.01) |
| ***C21D 8/04*** | (2006.01) |

(52) U.S. Cl.

CPC ..... *C22C 38/32* (2013.01); *C22C 38/38* (2013.01); *C22C 38/42* (2013.01); *C22C 38/44* (2013.01); *C22C 38/48* (2013.01); *C22C 38/50* (2013.01); *C22C 38/54* (2013.01); *C21D 2211/002* (2013.01); *C21D 2211/004* (2013.01); *C21D 2211/005* (2013.01)

(56) References Cited

U.S. PATENT DOCUMENTS

| | | | | |
|---|---|---|---|---|
| 2005/0183798 | A1 | 8/2005 | Kobayashi et al. | |
| 2009/0092514 | A1* | 4/2009 | Asahi | B21B 3/00 420/90 |
| 2014/0216609 | A1* | 8/2014 | Nakata | C21D 6/00 148/505 |
| 2014/0261919 | A1* | 9/2014 | Samuel | C22C 38/58 148/645 |
| 2014/0290807 | A1* | 10/2014 | Goto | C22C 38/58 148/506 |
| 2014/0299237 | A1* | 10/2014 | Somani | C21D 1/18 148/602 |
| 2015/0267281 | A1* | 9/2015 | Song | C22C 38/00 420/120 |

* cited by examiner (B)

(A)

LINE PIPE STEELS AND PROCESS OF MANUFACTURING

RELATED APPLICATION

The instant application claims priority of U.S. Provisional Application No. 61/792,794 filed on Mar. 15, 2013, the contents of which are incorporated herein by reference in their entirety.

FIELD OF THE INVENTION

The instant application is related to a line pipe steel and a process for making a line pipe steel, and in particular to a line pipe steel having excellent mechanical properties and relatively low contents of additional alloying elements.

BACKGROUND OF THE INVENTION

The use of high strength steels in piping used in oil and gas transmission lines, often referred to as "line pipe" is known. Different grades of line pipes such as "X80", "X90", and "X100" are also known. The grade terminology refers to the minimum yield strength of the material, i.e. X80 having minimum yield strength of 80,000 pounds per square inch (ksi), X90 having minimum yield strength of 90 ksi, and X100 having minimum yield strength of 100 ksi. In addition, such grades of steel are required to have acceptable toughness properties, i.e. charpy energy and shear area, and drop weight tear test (DWTT) shear area and respective low transition temperatures between ductile and brittle fracture mode. The onset of transition temperature range for DWTT required for specifications such as those of the API (American Petroleum Institute) is taken by the temperature at which at 85% ductile shear area is present on surfaces of a sample that exhibits complete fracture during the test.

Heretofore alloy compositions have included relatively high amounts of alloying elements in order to meet the combination of high strength and high toughness requirements. Naturally, such an increase in alloying elements results in an increase in alloy cost. Therefore, an alloy and a process for producing an alloy that has reduced alloying elements and yet exhibits excellent strength and toughness properties that meet X80, X90 and X100 requirements would be desirable.

SUMMARY OF THE INVENTION

A process for producing high strength steel is provided. The process includes providing a steel slab having a chemical composition in weight percent (wt %) within a range of 0.025-0.07 carbon (C), 1.20-1.70 manganese (Mn), 0.050-0.085 niobium (Nb), 0.022 maximum (max) titanium (Ti), 0.065 max nitrogen (N), 0.0040 max sulfur (S), 0.10-0.45 silicon (Si), 0.070 max phosphorus (P), with the remainder or balance being iron (Fe) and incidental impurities. The steel slab is soaked within a temperature range of 1150-1230° C. and then hot rolled using a roughing treatment in order to produce a transfer bar. In addition, the transfer bar is subjected to a finishing treatment in order to produce hot rolled strip and the hot rolled strip is cooled using a cooling rate between 10-100° C./second (sec). In some instances, the cooling rate is greater than 100° C./sec. The cooled hot strip is coiled within a temperature range of 580-400° C. Also, the coiled hot rolled strip has a yield strength of at least 80,000 pounds per square inch (80 ksi) and a DWTT transition temperature equal or less than −20° C.

In some instances, the entry temperature for the finishing treatment is less than or equal to 980° C. For example, the entry temperature for the finishing treatment can be between 920-960° C. The exit temperature of the finishing treatment is equal to or greater than 800° C.

The finishing treatment includes hot rolling with a number of finishing treatment hot rolls and the transfer bar is subjected to at least a 10% reduction at each hot rolling stand. Also, the finishing treatment can include between 4 to 7 finishing hot rolling stands.

The coiled hot rolled strip has a microstructure with less than 3 volume percent (vol %) of pearlite and less than 3 vol % martensite. The microstructure also has an ASTM grain size equal to or greater than 12.

The quantity of Nb and C in weight percent obeys the relationship log (NB×C)≤−2.33 and the ratio of Ti to N is between 2.0 4.0. In some instances, the chemical composition of the steel slab includes 0.40 max Cr, 0.30 max Mo, 0.006 max B, and 0.60 max Cu+Ni. Also, the P content may or may not be less than or equal to 0.020. For example, the P content can be between 0.020 0.070 without detrimental effects to the material's mechanical properties.

The coiled hot rolled strip can have a thickness up to 25.4 millimeters (mm) (1.000 in) and a minimum yield strength of 80 ksi (552 MPa). In the alternative, the hot rolled coil can have a minimum yield strength of at least 90 ksi (620 MPa) and a thickness up to 15 mm (0.590 in). In another alternative, the coiled hot rolled strip has a yield strength of at least 100 ksi (689 MPa) and a thickness up to 12 mm (0.472 in). In addition the coiled hot rolled strip may or may not be used to manufacture line pipe for use in the oil and gas industry.

The above properties are provided at least in part by a relatively low dropout temperature from a soaking furnace and hot rolling within a roughing mill—also known as a rougher. The roughing treatment includes a 3, 5, 7 or 9 pass reduction schedule—at or just above the non-recrystallization temperature (Tnr) for a given alloy. For the purposes of the instant invention, Tnr is the temperature below which complete static recrystallization no longer occurs. For the purposes of the instant invention, the term "just above the Tnr" refers to a temperature ($T_{\geq Tnr}$) or temperature range that is within 50° C. above the calculated Tnr ($Tnr \leq T_{\geq Tnr} \leq Tnr+50°$ C.) a given steel alloy. In addition, it has been observed that exiting the final roughing stand at temperature "just below" the calculated Tnr also shows optimum shear properties. In this case the term just below Tnr refers to a temperature ($T_{\leq Tnr}$) or temperature range that is within 20° C. below the calculated Tnr a given steel alloy ($T_{nr} \geq T_{\leq Tnr} \geq T_{nr}-20°$ C.).

In addition, the hot rolled strip is subjected to accelerated cooling before coiling at cooling rates between 10° C./sec and 100° C./sec. Finally, time between exiting the finishing hot rolling mill and application of cooling is less than or equal to 10 seconds.

For the purpose of the current invention the Tnr temperature is given by the following formula:

$$Tnr\ (°\ C.)=887+464\cdot\%\ C+6445\cdot\%\ Nb-644\cdot(\%\ Nb)^{1/2}+732\cdot\%\ V-230\cdot(\%\ V)^{1/2}+890\cdot\%\ Ti+363\cdot\%\ Al-357\cdot\%\ Si-\phi \quad (1)$$

where $\phi=100$ and is the mill specific constant, which in the current embodiment gives the measure of the true Tnr for the current rolling practice under dynamic mill conditions with rolling load and temperatures taking care of the skew in the temperature set point when using the predicted Tnr from empirically calculated established formulas. The established set point for measured Tnr using equation 1 is corroborated with the final optimized YS, TS and shear properties as claimed in the current invention. With the ideal properties obtained around +/−20° C. from the calculated Tnr from equation 1, it is observed that the actual value of the Tnr with the assigned constant ϕ can be obtained within an accuracy range of +/−40° C. or better. In addition, the parameters of % C, % Nb, % V, % Ti, % Al and % Si in the equation represent contents mass % of elements C, Nb, V, Ti, Al and Si in the steel slabs.

DETAILED DESCRIPTION OF THE INVENTION

The present invention provides a low C Nb-based steel and a process for making the steel such that coil plate having a minimum yield stress of 80 ksi for thicknesses up to 25 millimeters (mm), a minimum yield strength of 90 ksi up to 15 mm, and a minimum yield strength of 100 ksi up to 12 mm is provided. In addition, the inventive steel and process provide for a transition temperature for DWTT that is less than or equal to −20° C. with a fracture surface exhibiting at least 85% ductile fracture.

The steel is produced according to a low dropout temperature from a soaking or reheating furnace, the dropout temperature being between 1150 and 1230° C. As such, the steel is subjected to a low hot strip mill roughing practice start temperature that is at or just above the non-recrystallization temperature ($T_{\geq Tnr}$) with the final roughing pass being executed at or just above Tnr ($T_{\geq Tnr}$), or in the alternative, at or just below the Tnr ($T_{\leq Tnr}$). In addition, there is limited or no waiting time for the steel in front of the final roughing pass. The finish rolling temperature is well below the Tnr but above the austenite to ferrite transformation temperature, also known as the ferrite start temperature (Ar3).

Sufficient milling force is applied to accumulate sufficient strain and hot strip mill stand reduction to develop a fine grain size of ASTM 12 or finer/smaller, the microstructure having acicular ferrite. Also, the coiling temperature is above the martensite start temperature.

Figure 1:
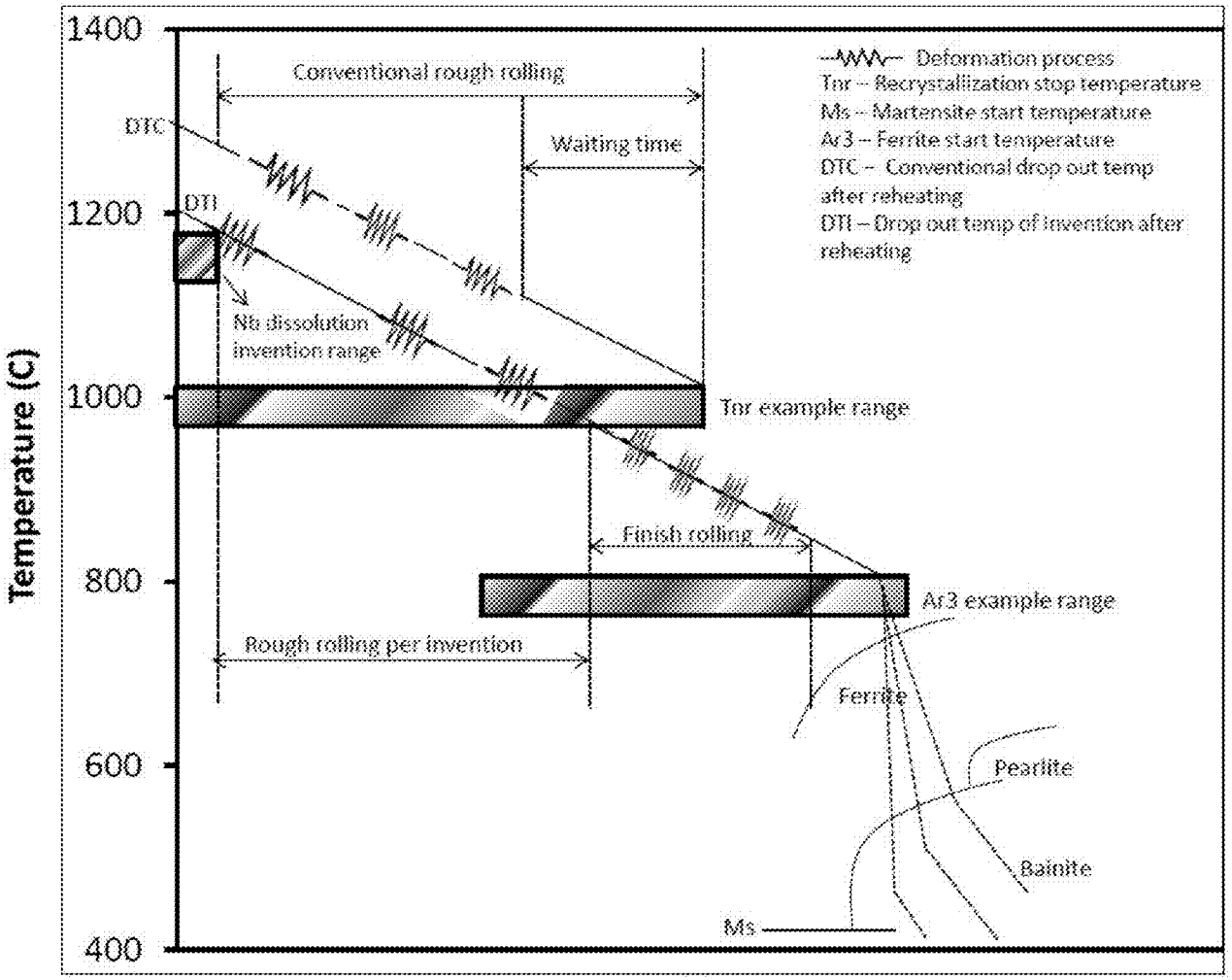
FIG. 1 is a schematic diagram illustrating the processing of line pipe steels according to an embodiment of the present invention.

Turning now to FIG. 1, a temperature versus time diagram is shown for a process to produce the line pipe steel according to an embodiment of the present invention. As shown by the diagram, the dropout temperature for the instant invention (DTI) versus a traditional or conventional dropout temperature (DTC) is substantially lower. For example, the schematic diagram shows a DTI of approximately 1200° C. After the dropout, hot rolling is performed in a roughing station with a final rough rolling pass taking place within or just above, or in the alternative, at or just below the Tnr, and with limited or no waiting time in front of the final rough rolling pass. Thereafter, the rough finished transfer bar is subjected to finishing rolling which is completed well above Ar3 for the particular steel alloy, which is naturally followed by accelerated cooling.

It should be appreciated, and as shown by the dotted lines in FIG. 1, pearlite must be avoided in the microstructure and thus the amount of C is limited such that the transformation of any remaining C occurs predominantly as fine carbides, preferably in the range of bainite transformation. In addition, the ferrite grain must be refined and as such utilization of grain refining elements such as Nb and Ti can be used. Given that grain refinement is the only strength mechanism that can increase toughness and strength at the same time, the instant invention provides an alloy composition and thermomechanical processing such that well balanced alloy combinations and contents of Nb, C, Ti, and N provide an optimum grain refinement at low production cost. Furthermore, ferrite developed in the bainite range has an even finer grain size than equiaxed ferrite and thus the contribution of bainitic ferrite to the microstructure is a desired feature.

Precipitation hardening is a contributing factor to strength but must be limited due to its deterioration of toughness. Solid solution hardening elements such as silicon and manganese can be necessary for increasing strength but also deteriorate toughness. However, lower manganese levels are known to promote strain induced Nb-carbide precipitation which can result in less free Nb being available for later precipitation hardening after rolling.

Martensite, and especially martensite in an elongated shape in the rolling direction and especially at the center line of the rolled material, is detrimental for toughness and transmission line pipe gas applications, namely due to reduced hydrogen induced cracking (HIC) resistance. For this reason the Mannesmann rating for the material must be 2 or lower for a cast slab of material received from a melt shop where the Mannesmann rating is an inclusion rating known to those skilled in the art. Elongated Mn-sulfide particles must be minimized or avoided and thus S limitation is mandatory. Also, calcium shape control of any precipitated sulfide is required. The limitation of S is also controlled to provide or allow Ti for combining with N to form Ti-nitride.

It is appreciated that a C content as low as 0.030 improves toughness, ductility, as well as reduced segregation in the slab centerline regions, which is necessary for improving toughness and resistance against sour gas atmospheres. Low C also aids in Nb carbide solubility and improves weldability by lowering the C equivalent of the steel alloy. In particular, low C contents increase the Nb carbide solubility and thus increase the amount of solute Nb. Also, the increase in solute Nb raises the austenite recrystallization to higher temperatures and thus retards the transformation of ferrite and promotes Nb carbides in the ferrite and higher bainite.

As stated above, the Ti to N ratio is between 2.0-4.0, and is preferably greater than 3.42. Nitrogen has a higher affinity towards Ti than Nb. Therefore, Ti nitride (TiN) forms at higher temperatures, is stable during reheating of the slabs, and prevents grain coarsening. Also, a lack of free N due to TiN formation improves the toughness of the material and helps in the effective participation of NbC strengthening. Similar to low C contents, low N increases the solubility of Nb and the high Nb solubility at relatively low temperatures improves the usage of low furnace reheating temperatures for homogenization of Nb within the slabs. It is appreciated that low reheat temperatures save fuel, improve productivity, and also improve grain refinement.

The prior art has taught that phosphorus segregates to grain boundaries and thus deteriorates toughness. However, the instant invention provides unexpected and beneficial results for using P as an optional alloying element. For example, P can be increased up to 0.070, which is appreciated to be outside the API standard allowance level, but as will be described in detail below, the inventive steels still meet DWTT requirements. As such, P can optionally be between 0.020-0.070.

In one embodiment, an aluminum killed low-S calcium (Ca) treated steels having a chemical composition in weight percent between 0.025 0.070 C, 1.20 1.70 Mn, 0.050 0.085 Nb, 0.022 maximum (max) Ti, 0.065 max N, 0.0040 max S, 0.10 0.45 Si, 0.022 P, with the remainder or balance being iron (Fe) and any incidental impurities known to those skilled in the art of steel production are melted and cast into slabs. In addition, the quantity of Nb and C of the steel slabs obey the expression $\log(Nb \cdot C) \leq -2.33$.

Figure 2:
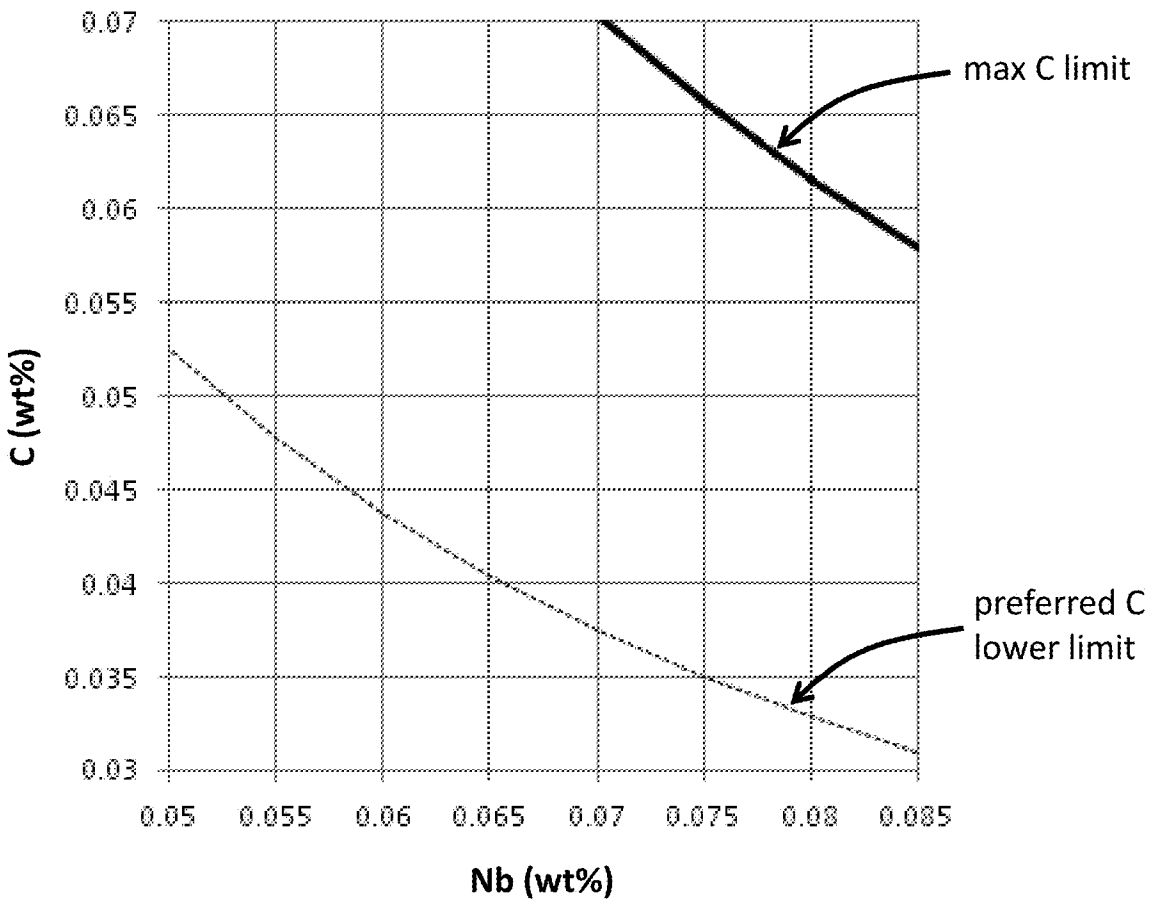
FIG. 2 is a graphical plot illustrating amount of carbon versus amount of niobium contained within line pipe steels according to an embodiment of the present invention.

Referring to FIG. 2, the solid line shown in the figure represents the above expression with the upper limit representing 1170° C. for Nb dissolution. In addition, the preferred combinations of Nb and C are shown between the dotted line and solid line in FIG. 2.

Slabs having the above-identified chemistries are provided with a Mannesmann rating of 2 or lower and having a thickness between 200 and 300 mm. Hot rolling of the slabs is initiated by reheating of the slabs and dissolving Nb into solid solution and transforming the slab into a completely austenitic microstructure. The temperature range for the soaking of the slabs is between 1150-1230° C. before being dropped out of the reheat furnace. The timing of the dropout is chosen such that the hot rolled strip or transfer bar does not sit or wait in front of the last rough rolling pass more than 100 seconds. This reduced waiting in front of the last roughing stand is important since Nb precipitation does not occur at the elevated temperatures present at this stage of the process and thus there is no pinning force of grain boundaries by Nb precipitates. As such, grain growth can occur if longer wait times are incurred. In addition, excessive or too high dropout temperatures require rocking/oscillation of transfer bars to lower the temperature such that the rougher exit temperature is not too high or above Tnr. The loss of productivity in terms of rocking/oscillation time is given by:

$$\text{oscillation time (s)} = 1.40\Delta T - 252 \quad (1)$$

where ΔT is the furnace dropout temperature minus the rougher exit temperature.

The finishing treatment entry temperature is between 920-960° C. such that austenitic grain size is minimized through low roughing temperatures and times. A finer austenite grain size leads to improved grain pancaking during finishing mill rolling and thus finer ferrite grain size after transformation. In addition, the first passes of the finishing mill rolling promote strain induced precipitation prior to recrystallization.

The rough rolled strip has a minimum thickness of 50 mm before entering the finishing train/finishing rolling treatment in which between four and seven rolling stands are utilized with a plan in which each rolling stand provides at least 10% reduction in thickness in order for sufficient penetration of strain to occur across the entire cross section. Interstand cooling in combination with idling of one or more stands can be utilized to decrease the surface temperature of the strip compared to a core temperature. Such an effect affords for better penetration of strain to the core in the last rolling stands which is a preferred practice for thicknesses of more than 12 mm. It should be appreciated that the finishing train must be equipped with sufficient drive power for a required roll force and torque.

The finishing temperature is not lower than 800° C. and is above Ar3, followed by cooling with a cooling rate between 10-100° C./sec not later than 10 seconds after leaving the finishing stand. Finally, the hot strip is coiled at a temperature lower than 580° C., but well above the martensite start temperature which is above 400° C.

In the current embodiment the desired fine bainitic ferrite microstructure and a structure devoid of pearlite is obtained not only by the balanced alloying composition but is a synergistic effect of chemistry with advanced mill processing with respect to accelerated cooling. The cooling of the hot rolled strip is achieved by utilizing six reinforced cooling zones immediately exiting the finishing stand followed by eight micro cooling zones which is again followed by another six reinforced cooling zones towards the end of the laminar cooling facility. An available water capacity of greater than 15,000 $m^3$/hr is used to achieve desired cooling rates over a laminar cooling length of 150 m.

For the purpose of the current invention, the term "reinforced cooling zone" refers to having two additional valves at both top and bottom locations, thereby giving a total of six top and six bottom water cooling valves at each of the six cooling zones at the start and towards the end of the laminar cooling section. As such, the reinforced cooling zones are differentiated from four headers per cooling zone located in traditional laminar cooling systems. In addition, the "micro cooling zone" used herein signifies traditional cooling arrangements with four headers per cooling zone location. Additionally the top and bottom cooling practice ensure cooling to the center of the strip leading to uniform microstructure and grain size across the cross section especially for thicker gauges.

Figure 3:
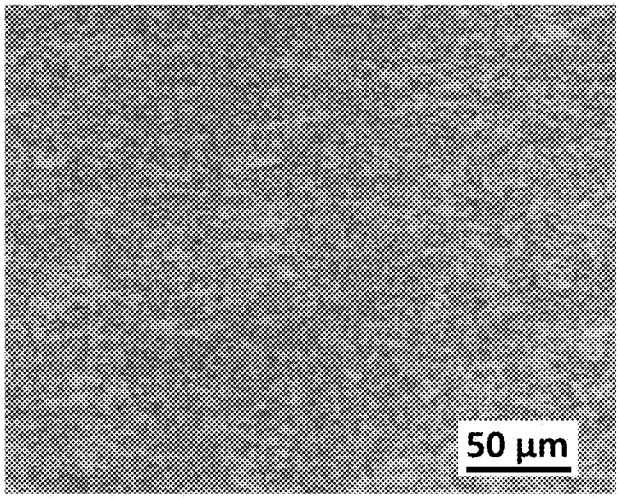
FIG. 3 is: (A) a scanning electron microscopy (SEM) image at a magnification of 5500× showing the microstructure at the center line of hot rolled strip to be used to fabricate line pipe according to an embodiment of the present invention; and (B) an optical micrograph at a magnification of 500× of the centerline microstructure of a hot rolled strip to be used to fabricate line pipe steel according to an embodiment of the present invention.
Figure 3:
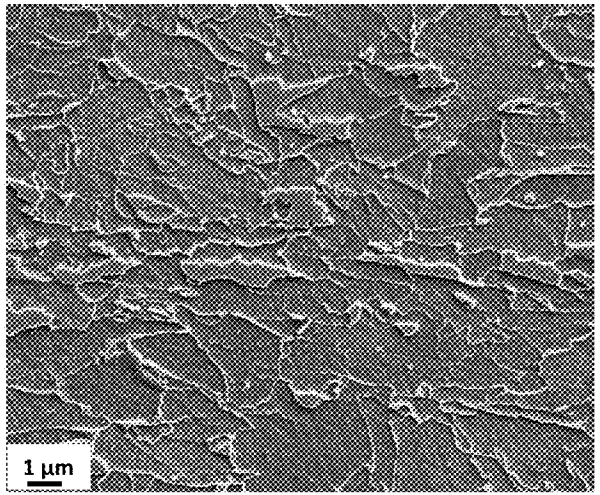
Figure 4:
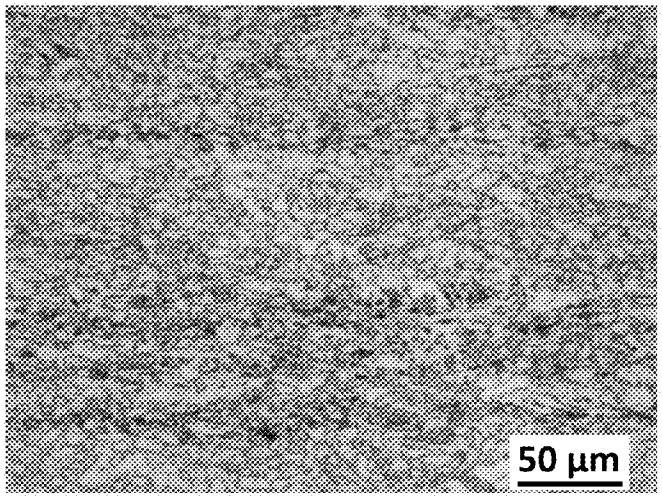
FIG. 4 is an optical micrograph at a magnification of 500× of the centerline microstructure of a hot rolled strip to be used to fabricate line pipe steel but processed according to conventional hot rolling procedures.

The above-stated alloy composition in combination with the above-stated process provides a microstructure with less than 3% volume fraction percent of pearlite and less than 3% volume fraction percent of martensite. In addition, an ASTM grain size of 12 and finer throughout the thickness of the strip is obtained. An example of such a microstructure is shown in FIGS. 3(A) and 3(B) where a ferrite-bainite microstructure is shown with an ASTM grain size of 13.66. In contrast, a microstructure of the centerline for a similar steel processed using a conventional hot rolling treatment—a dropout temperature of 1275° C., a finishing entry temperature of 1059° C., a finishing exit temperature of 866° C. and a coiling temperature of 600° C., is shown in FIG. 4.

As shown by the micrograph, the microstructure has an undesired mixed microstructure with coarser grains.

It should be appreciated that widely accepted state-of-the-art line pipe steels have 0.100 weight percent Nb whereas the instant steel has a much lesser amount, and yet achieves the same desired strength and toughness. In addition, savings of energy in the reheating of slabs to lower temperatures than traditional line pipe steel grades is provided. The intended dissolution of Nb at such low dropout temperatures is obtained by applying the disclosed Nb and C maximum levels and by adding Ti in a stoichiometric amount to N which eliminates Nb—C— nitride precipitation during slab casting and solidification. Applying higher than the disclosed dropout temperatures with alloy compositions of the present invention runs the risk of excessive grain growth during reheating of the slab which is to be avoided.

A further advantage of the disclosed practice is the elimination of P from being detrimental to toughness by having a coiling temperature of less than 580° C. A yet other advantage of the present invention is decreasing or even eliminating the waiting time in front of a final roughing pass which makes the process highly productive compared to current state-of-the-art practices which use only low temperature finish rolling practices but combined with higher dropout temperatures in order to dissolve all Nb.

In order to better teach the invention, but in no way limit the scope thereof, examples of line pipe steels according to one or embodiments of the invention are discussed below.

A slab having a chemical composition in wt % of 0.059 C—1.532 Mn—0.009 P—0.0015 S—0.313 Si—0.027 Al—0.005 Cu—0.012 Ni—0.21 Cr—0.12 Mo—0.002 V—0.067 Nb—0.017 Ti—0.005 N—0.0032 Ca—0.0005 B—balance Fe and incidental impurities for an X80 line pipe steel was processed according to an embodiment of the present invention. The slab had a width of 1575 mm and was reheated with a dropout temperature of 1212° C. and a last roughing pass exit temperature and finishing train entry temperature of 945° C. A waiting time before the last roughing pass was 50 seconds and a strip thickness after the last roughing pass was 54.75 mm. The reductions in thickness during the finishing rolling were 33% at a first stand, 33% at a second finishing stand, 23% at a third stand, 17% at a fourth stand, 16% at a sixth stand, and 16% at a final and seventh stand.

The final thickness of the hot rolled strip was 11.3 mm and the finishing temperature was 838° C. The cooling onset was 5 seconds after leaving the last finishing stand, with an average cooling rate of 60-70° C./sec to the exit of the laminar cooling section. The coiling temperature was 555° C. The resulting transverse testing properties (ASTM) were 638 MPa yield strength, 678 MPa tensile strength, 39% total elongation; and Charpy V Notch for 7.5 mm×10 mm transverse specimens at −20° C. were 312 joules (J), 327 J, 326 J—giving an average of 322 J. Also, samples exhibited 100% ductile fracture for DWTT at −20° C. and −40° C.

In addition to the above, a number of steel slabs having varying amounts of C and P were subjected to different processing parameters in order to determine the effect of rougher exit temperature, P content and C content on mechanical properties. In particular, Table 1 below shows the effect of rougher exit temperature ($T_{RE}$) on toughness (CVE). Also shown are the soaking furnace drop out temperatures ($T_{FDO}$), finishing mill exit temperatures ($T_E$) and coiling temperatures ($T_C$).

Figure 5:
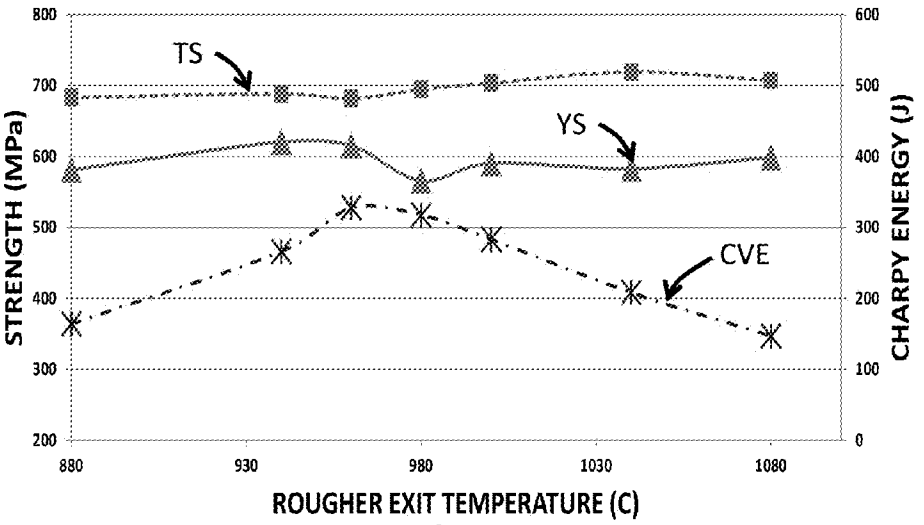
FIG. 5 is a graphical plot illustrating tensile strength (TS), 0.5% yield strength (YS) and Charpy V-Notch Energy at −18° C. (CVE) as a function of rougher exit temperature for a line pipe steel according to an embodiment of the present invention.

As shown in Table 1 and illustrated in FIG. 5, roughing at temperatures too below Tnr, or too high above Tnr, results in a loss of charpy toughness (CVE). In particular, having a rougher exit temperature of 838° C. resulted in a charpy energy at −18° C. of 164 joules (J) whereas a rougher exit temperature between 940-1000° C. resulted in charpy energies between 266-328 J. Also, for rougher exit temperatures of 1040 and 1080° C., charpy energies of 208 and 147 J, respectively, were exhibited by the steel alloys. It is appreciated that the dropout temperature is expected to have similar effect as the rougher exit temperature on mechanical properties. In particular, it has been found that dropout temperature and rougher exit temperature are linearly related by the expression:

$$\text{Rougher temperature (° C.)} = \text{Dropout temperature (° C.)} - 180\text{° C.} \quad (2)$$

Figure 6:
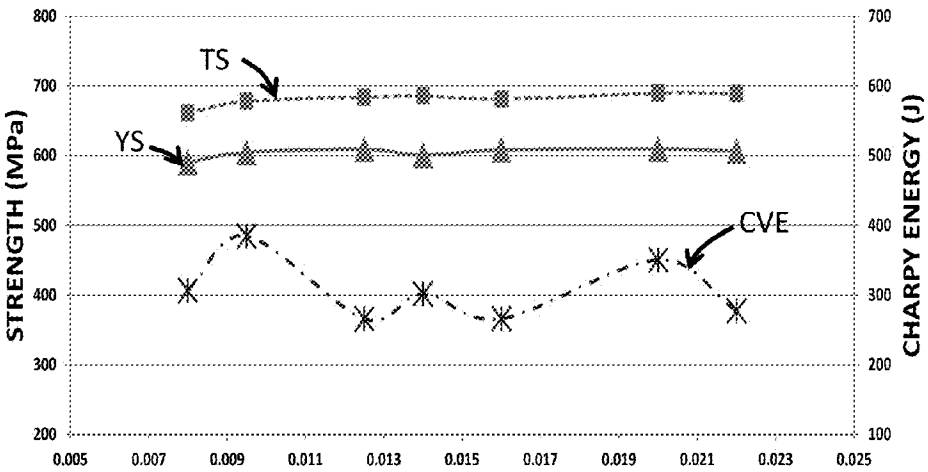
FIG. 6 is a graphical plot illustrating tensile strength (TS), 0.5% yield strength (YS) and Charpy V-Notch Energy at −18° C. (CVE) as a function of phosphorous (P) content (wt %) for line pipe steels according to an embodiment of the present invention.

Regarding the effect of P within the line pipe steels disclosed herein, Table 2 and FIG. 6 illustrate that the inventive steel grades and processing thereof are relatively insensitive to P content. In particular, Table 2 shows P contents between 0.008 and 0.022, and all of the steel alloys shown in the table exhibited charpy energies of at least 266 J. It should be appreciated that such an insensitivity to P content is by itself an unexpected result.

Figure 7:
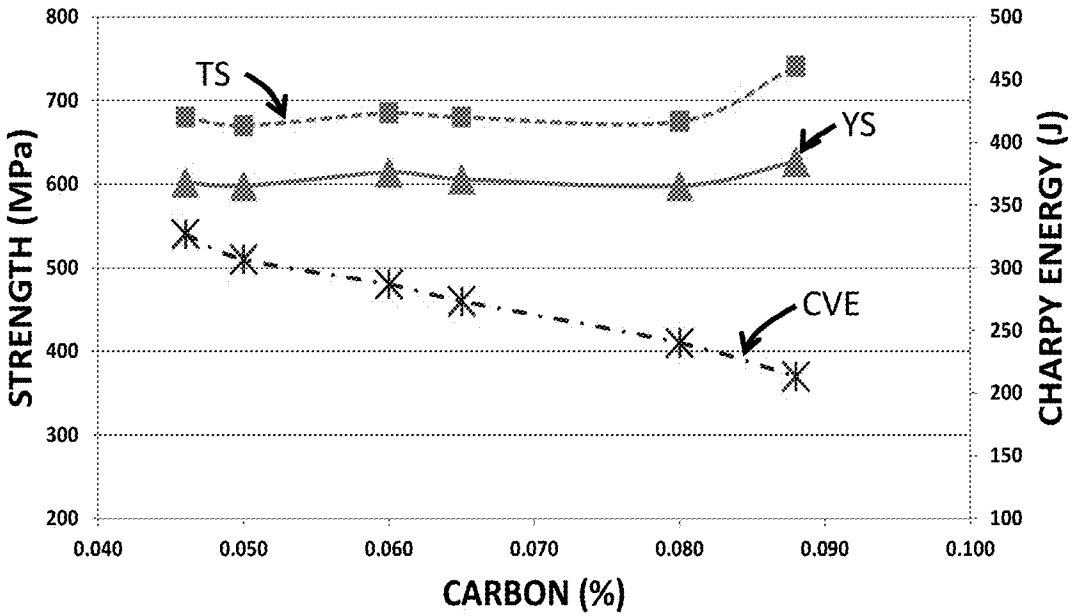
FIG. 7 is a graphical plot illustrating tensile strength (TS), 0.5% yield strength (YS) and Charpy V-Notch Energy at −18° C. (CVE) as a function of C content (wt %) for line pipe steels according to an embodiment of the present invention.

Table 3 and FIG. 7 illustrate the effect of C on the mechanical properties of inventive line pipe steels disclosed herein, with the basic result being an increase in C reduces the toughness of the material.

TABLE 1

| STEEL | C | Mn | Nb | Ti/N | YS (MPa) | TS (MPa) | % E | CVE (J at −18° C.) | $T_C$ (° C.) | $T_F$ (° C.) | $T_{RE}$ (° C.) | $T_{FDO}$ (° C.) |
|---|---|---|---|---|---|---|---|---|---|---|---|---|
| A1 | 0.059 | 1.53 | 0.072 | 3.1 | 581 | 683 | 30 | 164 | 595 | 838 | 880 | 1220 |
| A2 | 0.054 | 1.55 | 0.064 | 3.3 | 621 | 688 | 39 | 266 | 560 | 840 | 940 | 1218 |
| A3 | 0.052 | 1.56 | 0.066 | 3.4 | 615 | 682 | 37 | 328 | 570 | 833 | 960 | 1221 |
| A4 | 0.061 | 1.58 | 0.068 | 2.3 | 566 | 695 | 27 | 317 | 540 | 836 | 980 | 1225 |
| A5 | 0.054 | 1.51 | 0.063 | 4.1 | 590 | 704 | 25 | 283 | 590 | 833 | 1000 | 1255 |
| A6 | 0.055 | 1.51 | 0.066 | 3.4 | 583 | 719 | 28 | 208 | 595 | 833 | 1040 | 1240 |
| A7 | 0.055 | 1.51 | 0.066 | 3.4 | 599 | 707 | 27 | 147 | 590 | 833 | 1080 | 1253 |

TABLE 2

| STEEL | C | Mn | Nb | Ti/N | P | YS (MPa) | TS (MPa) | % E | CVE (J at −18° C.) | $T_C$ (° C.) | $T_F$ (° C.) | $T_{RE}$ (° C.) | $T_{FDO}$ (° C.) |
|---|---|---|---|---|---|---|---|---|---|---|---|---|---|
| B1 | 0.054 | 1.54 | 0.063 | 2.10 | 0.008 | 590 | 661 | 40 | 307 | 570 | 835 | 950 | 1224 |
| B2 | 0.054 | 1.53 | 0.065 | 3.10 | 0.010 | 605 | 678 | 39 | 385 | 565 | 826 | 953 | 1222 |
| B3 | 0.058 | 1.56 | 0.064 | 2.50 | 0.013 | 609 | 684 | 34 | 266 | 550 | 824 | 940 | 1215 |

TABLE 2-continued

| STEEL | C | Mn | Nb | Ti/N | P | YS (MPa) | TS (MPa) | % E | CVE (J at −18° C.) | $T_C$ (° C.) | $T_F$ (° C.) | $T_{RE}$ (° C.) | $T_{FDO}$ (° C.) |
|---|---|---|---|---|---|---|---|---|---|---|---|---|---|
| B4 | 0.055 | 1.56 | 0.066 | 3.10 | 0.014 | 601 | 686 | 37 | 302 | 545 | 830 | 945 | 1212 |
| B6 | 0.054 | 1.54 | 0.069 | 3.60 | 0.016 | 608 | 681 | 39 | 266 | 573 | 826 | 938 | 1215 |
| B8 | 0.057 | 1.57 | 0.065 | 3.70 | 0.020 | 610 | 690 | 44 | 350 | 562 | 824 | 956 | 1220 |
| B9 | 0.058 | 1.50 | 0.066 | 3.00 | 0.022 | 607 | 689 | 43 | 277 | 565 | 814 | 943 | 1206 |

TABLE 3

| STEEL | C | Mn | Nb | Ti/N | YS (MPa) | TS (MPa) | % E | CVE (J at −18° C.) | $T_C$ (° C.) | $T_F$ (° C.) | $T_{RE}$ (° C.) | $T_{FDO}$ (° C.) |
|---|---|---|---|---|---|---|---|---|---|---|---|---|
| C1 | 0.046 | 1.57 | 0.066 | 2.10 | 602 | 680 | 31 | 327 | 570 | 835 | 950 | 1224 |
| C2 | 0.050 | 1.55 | 0.065 | 3.10 | 598 | 670 | 39 | 307 | 565 | 826 | 953 | 1222 |
| C3 | 0.060 | 1.57 | 0.063 | 2.50 | 614 | 685 | 32 | 287 | 550 | 824 | 940 | 1215 |
| C4 | 0.065 | 1.53 | 0.060 | 3.10 | 606 | 680 | 31 | 273 | 545 | 830 | 945 | 1212 |
| C6 | 0.080 | 1.55 | 0.068 | 3.60 | 598 | 675 | 42 | 240 | 573 | 826 | 938 | 1215 |
| C7 | 0.088 | 1.52 | 0.065 | 3.60 | 627 | 741 | 28 | 213 | 610 | 845 | 1010 | 1230 |

Given the ability of the steels and processing disclosed herein to meet the mechanical properties of the X80, X90, and X100 grades, such results should be appreciated to not be found in the prior art and thus are unexpected results. In addition, the above-described examples and embodiments are illustrative in nature and thus should not be interpreted to limit the scope of the invention. To those skilled in the art, changes, modifications, and the like can be made and yet still fall within the scope of the invention. As such, it the claims, and all equivalents thereof, that define the scope of the invention.

We claim:

1. A process for producing high strength steel, the process comprising:

providing a steel slab having a chemical composition in weight percent in a range of 0.025-0.070 C, 1.50-1.70 Mn, 0.050-0.085 Nb, 0.022 max Ti, 0.065 max N, 0.0040 max S, 0.10-0.45 Si, 0.070 max P, with the remainder or balance being iron (Fe) and incidental impurities, the quantity of Nb and C in weight percent obeys the relationship log(Nb·C) is less than or equal to −2.33 and a Ti to N ratio is between 2.0-4.0, inclusive;

soaking the steel slab between 1150-1230° C.;

hot rolling the steel slab using a roughing treatment and producing a transfer bar;

hot rolling the transfer bar using a finishing treatment and producing hot rolled strip;

cooling the hot rolled strip using a cooling rate between 10-100° C./sec; and coiling the cooled hot rolled strip at a temperature between 580-400° C., the coiled hot rolled strip, the coiled hot rolled strip having a yield strength of at least 80 ksi and a DWTT transition temperature equal to or less than −20° C.

2. The process of claim 1, wherein a dropout temperature for soaking of the steel slab is between 1150-1230° C.

3. The process of claim 1, wherein an exit temperature of the finishing treatment is equal to or greater than 800° C. and a time between exiting the finishing treatment and cooling of the hot rolled strip is less than or equal to 10 seconds.

4. The process of claim 1, wherein the microstructure has an ASTM grain size equal to or greater than 12.

5. The process of claim 1, wherein the chemical composition of the steel lab includes 0.40 max Cr, 0.30 max Mo, 0.006 max B and 0.60 max Cu+Ni.

6. The process of claim 1, wherein the P content is less than or equal to 0.020.

7. The process of claim 1, wherein the P content is between 0.020-0.070.

8. The process of claim 1, wherein the coiled hot rolled strip has a thickness up to 25 mm.

9. The process of claim 1, wherein the yield strength is at least 90 ksi.

10. The process of claim 9, wherein the coiled hot rolled strip has a thickness up to 15 mm.

11. The process of claim 1, wherein the yield strength is at least 100 ksi.

12. The process of claim 11, wherein the coiled hot rolled strip has a thickness up to 12 mm.

13. A hot rolled line pipe steel comprising:

a hot rolled strip having a chemical composition in weight percent within a range of 0.025-0.070 C, 1.50-1.70 Mn, 0.050-0.085 Nb, 0.022 max Ti, 0.065 max N, 0.0040 max S, 0.10-0.45 Si, 0.070 max P, 0.40 max Cr, 0.30 max Mo, 0.006 max B, 0.60 max Cu+Ni and with the remainder being iron Fe and incidental impurities and the quantity of Nb and C in weight percent obeys the relationship log(Nb·C) is less than or equal to −2.33;

a Ti to N ratio between 2.0-4.0, inclusive; and a yield strength of at least 80 ksi, a thickness up to 25.4 mm and a DWTT transition temperature equal to or less than −20° C.

14. The hot rolled line pipe steel of claim 13, wherein said P is less than or equal to 0.020.

15. The hot rolled line pipe steel of claim 14, wherein said P is between 0.020-0.070.

16. The hot rolled line pipe steel of claim 15, wherein said thickness is up to 15 mm and said yield strength is at least 90 ksi.

17. The hot rolled line pipe steel of claim 16, wherein said thickness is up to 12 mm and said yield strength is at least 100 ksi.

* * * * *